United States Patent [19]

Busse et al.

[11] 4,286,652

[45] Sep. 1, 1981

[54] GAS-CONTROLLED HEAT-PIPE THERMOSTAT OF HIGH PRECISION

[75] Inventors: Claus-Adolf Busse, Arolo di Leggiuno; Jean-Paul Labrande, Ispra, both of Italy

[73] Assignee: Cabinet A. Zewen, Luxembourg-Ville, Luxembourg

[21] Appl. No.: 673,876

[22] Filed: Apr. 5, 1976

[30] Foreign Application Priority Data

Apr. 4, 1975 [LU] Luxembourg ..... 72212

[51] Int. Cl.[3] ..... F23D 15/00

[52] U.S. Cl. ..... 165/96; 165/104.26; 219/210; 219/399; 219/401

[58] Field of Search ..... 165/105, 96; 219/209, 219/210, 530, 399, 401, 271; 73/15 R

[56] References Cited

U.S. PATENT DOCUMENTS

| | | | |
|---|---|---|---|
| 3,272,258 | 9/1966 | Bourquard | 165/105 X |
| 3,585,842 | 6/1971 | Roof | 165/105 X |
| 3,702,533 | 11/1972 | Dirne et al. | 165/105 X |
| 3,965,334 | 6/1976 | Asselman et al. | 165/105 X |

OTHER PUBLICATIONS

Eurospectra Article, "Das Warmerohr-ein neues Warmeubertragungssystem" by Helmut Neu, pp. 51–60. Jun. 1970.

*Primary Examiner*—Albert W. Davis

*Attorney, Agent, or Firm*—Stevens, Davis, Miller & Mosher

[57] ABSTRACT

A gas-controlled heat-pipe thermostat of high precision comprising a closed pipe interiorly covered with a capillary structure; a gas pressure regulation system containing control gas in communication with the interior of the pipe and a working fluid. The pipe defines first and second condensation zones and an intermediate evaporation zone. The working fluid within the pipe upon reaching the evaporation zone is vaporizable and dividable into two portions, each portion flowable to one of the first and second condensation zones after which it returns to the evaporation zone by way of the capillary structure for recycling. The control gas of the gas pressure regulation system forms a buffer zone. The positioning of the evaporation zone in relation to the second condensation zone resulting in the evaporation condensation cycle through the first of the condensation zones is separated from the control gas by the evaporation condensation cycle through the second condensation zone.

3 Claims, 2 Drawing Figures

GAS-CONTROLLED HEAT-PIPE THERMOSTAT OF HIGH PRECISION

The invention concerns gas-controlled heat-chambers which are also known as heat-pipe thermostats.

It is known that the practically isothermic heat-pipe transfers latent heat of evaporation of a fluid from an evaporation zone to a condensation zone. In the course of this, a two-phase cycle is maintained in the interior of the pipe whereby capillary forces, for example, pass the fluid condensing in the condensation zone back to the evaporation zone.

The principle of the heat-pipe has already been known for several decades (U.S. Pat. No. 2,350,348). The use of heat-pipes in thermostat systems has already been proposed (Luxemburg Patent 57 482). In this, the heat-pipe is coupled to a gas-pressure control system, e.g., a gas reservoir at constant pressure, this being in such a manner that only a relatively narrow mixed zone of vapor and gas is obtained in the transitional zone. Under these circumstances a change in the heat passed to the evaporation zone causes a shift of the transitional zone and thus a corresponding change in the heat-emitting area.

In the ideal case with equipment of this kind, the correlation between the pressure of the control gas and the temperature of the pipe is determined by the vapor pressure curve of the working fluid used. In practice, there are a number of effects which cause deviations from this ideal correlation. One of these effects is the presence of control gas in the vapor of the working fluid which is due above all to the fact that control gas dissolves in the working fluid in the high gas partial pressure areas, then passes with the working fluid into the heated section of the heat-pipe and from there into the vapor when the working fluid is evaporated. The consequence of this is that (at a pre-determined control-gas pressure) the saturation temperature of the vapor falls and with it the temperature of the heat-pipe, this being in proportion to the magnitude of the gas partial pressure in the vapor.

Since the gas solubility effect described is dependent on the constructional features of the heat-chamber and its operating condition, it can scarcely be identified and anticipated in accordance with natural laws, the resultant fall in temperature must in general be regarded as an uncertain factor in the absolute temperature level of the chamber.

The invention is concerned with the problem of eliminating this uncertain factor in the temperature or at least of reducing it to a large extent.

Figure 1:
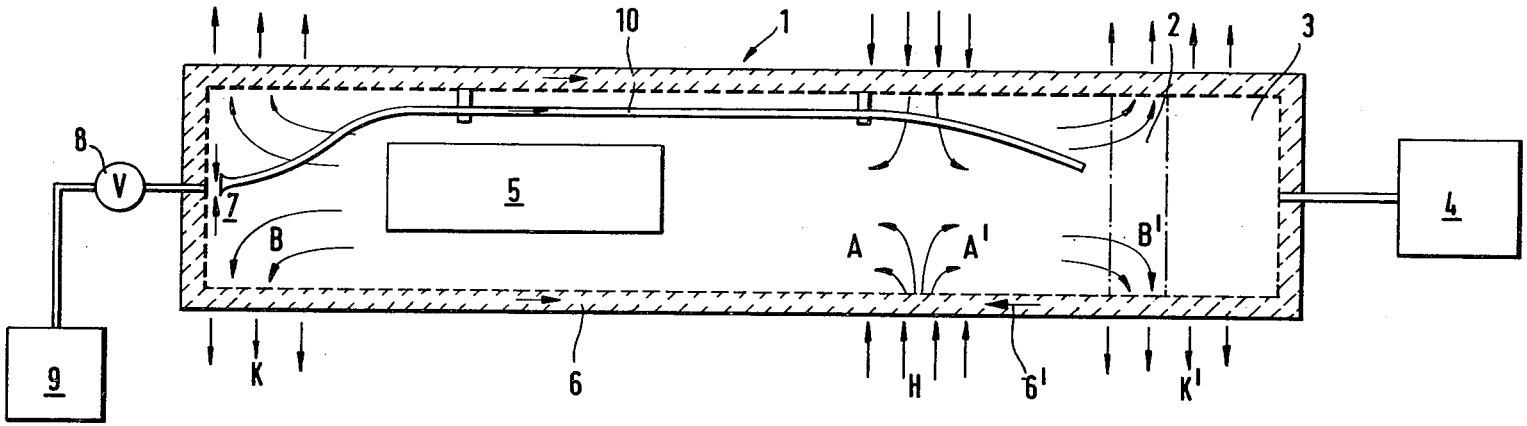

This problem is solved by the invention in that the effective evaporation-condensation cycle of the heat-pipe is separated from the control gas by an auxiliary evaporation-condensation cycle whereby both cycles advantageously have a common evaporation zone. The principle of the invention is explained in the following by means of FIG. 1.

In the schematic diagram, 1 designates a gas-controlled heat-chamber having a transitional zone 2 between vapor B′ and control-gas 3, the pressure of which is kept constant by a gas-pressure regulating system 4. By the supply of heat in the evaporation zone H two evaporation-condensation cycles result, namely the principal cycle A-B-A in which there is a temperature-controlled chamber 5 and the auxiliary cycle A′-B′-A′ which is directly adjacent to the transitional zone 2 and separates the latter from the principal cycle A-B-A. The working medium condensed in the cooling zones K and K′ respectively is returned in the directions shown by the arrows via the capillary structures 6 and 6′ respectively to the evaporation zone H.

The auxiliary cycle A′-B′-A′ contains a certain quantity of control gas through solution in the areas 2 and 3 of high gas partial pressure. The cycle A-B-A, which encloses the temperature-controlled chamber 5, contains very much less gas, however, since no gas buffer is present in the condensation zone of this cycle no gas can be dissolved.

Gas passes into the cycle A-B-A only through diffusion from the cycle A′-B′-A′. This gas is collected in the condensation zone 7 and leads there to the gradual build-up of a gas partial pressure. This build-up, as is known from experience, proceeds very slowly (for days) and can be avoided, for example, by the occasional (e.g. automatic) release of gas via the valve 8, e.g. in a vacuum chamber 9. A release of gas is particularly necessary when the heat-pipe is heated up since a fairly large part of the gas uniformly distributed throughout the heat-pipe in the cold state is confined in the condensation zone 7 by the vapor which starts to circulate.

In another form of execution of the invention, the release of gas can also take place towards the interior of the heat-pipe. For this, the cooling zone is temporarily heated, whereby the direction of circulation of the cycle A-B-A is reversed and the gas present at 7 is purged into the cycle A′-B′-A′ and from here onward to the control gas buffer 3.

A further advantageous form of execution of the invention concerns the arrangement of a small narrow tube 10 which is open at both ends in the vapor of the heat-pipe and extends from zone 7 to a point in the vapor of the cycle A′-B′-A′ where the pressure is somewhat lower than in zone 7. A point of this kind can be established, for example, by selecting the cross-sections of the vapor ducts and/or the magnitude of the quantities of heat dissipated in the cycles A-B-A or A′-B′-A′ in such a manner that the pressure gradient from A′ to B′ is greater than the pressure gradient from A to B. In this way there is a constant slight flow of vapor from zone 7 to the area B′ which prevents any significant accumulation of gas in zone 7. The loss of working fluid occurring in the cycle A-B-A through this secondary stream of vapor is automatically compensated by the flow of working fluid in the capillary structure from A′ to A. Since this additional flow consists of gas-contaminated fluid from the cycle A′-B′-A′, however, it should be kept as small as possible, i.e., the flow resistance in the tube 10 is to be such that it just prevents any significant accumulation of gas in zone 7 or, expressed in another way, such that an appreciable drop in temperature in zone 7 can no longer be determined (since, as already mentioned, an accumulation of gas leads to a drop in the temperature).

EXAMPLE

Figure 2:
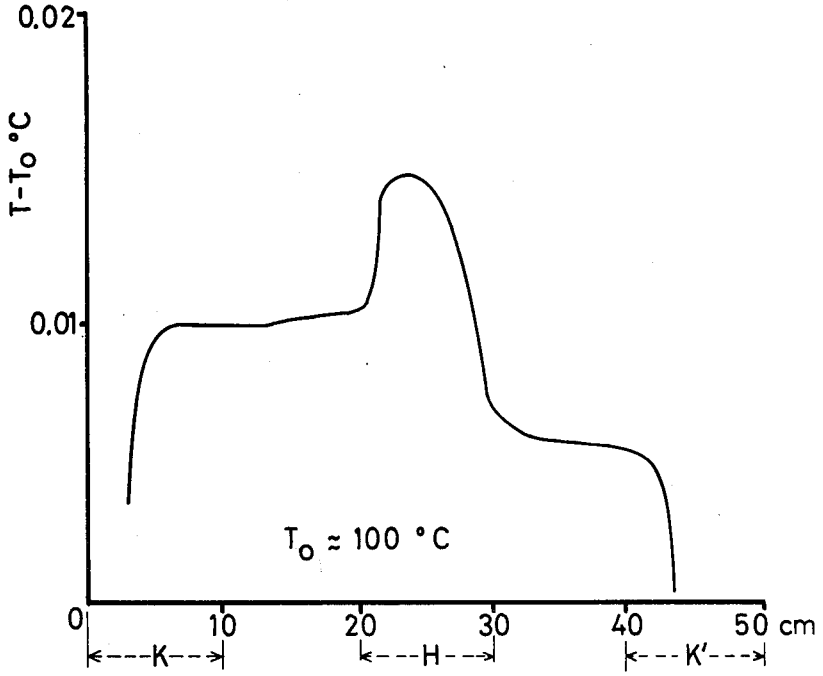

The proper functioning of the arrangement in accordance with the invention was confirmed by the measurement of the axial temperature distribution in a copper heat-pipe using water as the working fluid and argon as the control gas. The pipe was 50 cm long and had a vapor duct diameter of 1.2 cm. The temperature distribution was measured in a tube with an outer diameter of 0.5 cm, open at both ends and arranged axially in the heat-pipe with the aid of platinum resistances (sensitivity of measurement approx. $10^{-40°}$ C./cm). The capillary structure consisted of wire netting wound around the outer pipe and a thread on the inner tube. The graph as in FIG. 2 shows the temperature deviations T–To°C., whereby To=100° C. is the theoretical temperature of evaporation of the water, along the length of the tube. Analogous to FIG. 1, H, K and K' designate the evaporation zone and the two cooling zones. Two cycles consequently take place in the heat-pipe, there being HKH (effective zone) to the left and HK'H (auxiliary zone) to the right, as seen from the evaporation zone. The auxiliary zone is in direct contact with the control gas. The measurements, which were carried out in the stationary state after the heat-pipe had been moved into position, show at both ends of the evaporation zone two zones of constant temperature whereby a clearly higher temperature may be observed in the effective zone, the said higher temperature being attributed to the lower gas-content of the vapor circulating there. It was also found that the temperature in the effective zone remained constant for a longer time than in the auxiliary zone.

We claim:

1. A gas-controlled heat-pipe thermostat of high precision comprising a closed pipe interiorly covered with a capillary structure, said pipe defining first and second condensation zones and an intermediate evaporation zone; a gas pressure regulation system containing control gas in communication with said second condensation zone and a working fluid within said pipe which upon reaching said evaporation zone is vaporizable and dividable into two portions, each portion flowable to one of said first and second condensation zones after which it returns to said evaporation zone by way of said capillary structure for recycling, said control gas of said gas pressure regulation system forming a buffer zone, and said positioning of said evaporation zone in relation to said second condensation zone resulting in the evaporation condensation cycle through the first of said condensation zones being separated from the control gas by the evaporation condensation cycle through said second condensation zone.

2. A gas-controlled heat-pipe thermostat of high precision comprising a closed pipe interiorly covered with a capillary structure, said pipe defining first and second condensation zones and an intermediate evaporation zone; a low pressure chamber connected to said pipe through a valve at said first condensation zone; a gas pressure regulation system containing control gas in communication with said second condensation zone and a working fluid within said pipe which upon reaching said evaporation zone is vaporizable and dividable into two portions, each portion flowable to one of said first and second condensation zones after which it returns to said evaporation zone by way of said capillary structure for recycling, said control gas of said gas pressure regulation system forming a buffer zone, and said positioning of said evaporation zone in relation to said second condensation zone resulting in the evaporation condensation cycle through the first of said condensation zones being separated from the control gas by the evaporation condensation cycle through said second condensation zone.

3. A gas-controlled heat-pipe thermostat of high precision comprising a closed pipe interiorly covered with a capillary structure, said pipe defining first and second condensation zones and an intermediate evaporation zone; a gas pressure regulation system containing control gas in communication with said second condensation zone; a thin tube open at both ends to interconnect the first condensation zone and a point of lower control-gas partial pressure in the evaporation condensation cycle through said second condensation zone; and a working fluid within said pipe which upon reaching said evaporation zone is vaporizable and dividable into two portions, each portion flowable to one of said first and second condensation zones after which it returns to said evaporation zone by way of said capillary structure for recycling, said control gas of said gas pressure regulation system forming a buffer zone, and said positioning of said evaporation zone in relation to said second condensation zone resulting in the evaporation condensation cycle through the first of said condensation zones being separated from the control gas by the evaporation condensation cycle through said second condensation zone.

* * * * *

UNITED STATES PATENT AND TRADEMARK OFFICE

CERTIFICATE OF CORRECTION

ATENT NO. : 4,286,652

ATED : September 1, 1981

NVENTOR(S) : Claus-Adolf BUSSE, et al

It is certified that error appears in the above-identified patent and that said Letters Patent are hereby corrected as shown below:

ON THE TITLE PAGE :

Correct the name of Assignee from "Cabinet A. Zewen, Luxembourg-Ville, Luxembourg to -- European Atomic Energy Community (EURATOM), Centre Européen Kirchberg, Luxembourg --.

Signed and Sealed this

*Nineteenth* Day of *January 1982*

[SEAL]

*Attest:*

GERALD J. MOSSINGHOFF

*Attesting Officer*

*Commissioner of Patents and Trademarks*